US008096835B2

(12) United States Patent
Dufour et al.

(10) Patent No.: US 8,096,835 B2
(45) Date of Patent: Jan. 17, 2012

(54) ELECTRICAL CONNECTION PART FORMED BY A CASING WITH TWO ARMS ORIENTED AT 90°

(75) Inventors: Arnaud Dufour, Uccle (BE); Rémi Padel, Yokohama (JP); Guénolé Queffurus, Chantilly (FR)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 12/992,677

(22) PCT Filed: May 18, 2009

(86) PCT No.: PCT/EP2009/056012

§ 371 (c)(1),
(2), (4) Date: May 6, 2011

(87) PCT Pub. No.: WO2009/141312

PCT Pub. Date: Nov. 26, 2009

(65) Prior Publication Data

US 2011/0237133 A1 Sep. 29, 2011

(30) Foreign Application Priority Data

May 19, 2008 (FR) ..... 08 53211

(51) Int. Cl.
*H01R 13/66* (2006.01)

(52) U.S. Cl. ..... 439/620.05; 439/843

(58) Field of Classification Search ..... 439/620.05, 439/620.06, 620.07, 843–846
See application file for complete search history.

(56) References Cited

U.S. PATENT DOCUMENTS

| | | | | |
|---|---|---|---|---|
| 6,435,894 | B2 | 8/2002 | Little et al. | |
| 6,699,277 | B1 * | 3/2004 | Freidberg et al. | 623/1.13 |
| 6,743,051 | B2 * | 6/2004 | Hayashi | 439/620.05 |
| 6,799,983 | B2 * | 10/2004 | Pavlovic et al. | 439/181 |
| 6,893,277 | B2 * | 5/2005 | Parrish et al. | 439/188 |

(Continued)

FOREIGN PATENT DOCUMENTS

EP 1117159 A 7/2001

(Continued)

OTHER PUBLICATIONS

International Search Report and Written Opinion of the ISA, ISA/EP, Rijswijk, NL, mailed Aug. 24, 2009.

(Continued)

*Primary Examiner* — Tulsidas C Patel
*Assistant Examiner* — Phuong Nguyen
(74) *Attorney, Agent, or Firm* — Harness, Dickey & Pierce, P.L.C.

(57) ABSTRACT

An electrical connection part for electrically connecting first and second devices includes a casing having two arms oriented at 90° with respect to one another. This casing houses a pair of electrical connectors of which a first end is in the shape of a pin housed longitudinally in one of arms, while a second end is in the shape of a sleeve housed longitudinally in the other of the arms. These pins and sleeves may be electrically connected to matching sleeves carried by the first device, respectively to matching pins carried by the second device. The casing is formed by two independent parts including a body and a removable cover. The cover accommodates and/or locks the connectors. The arm which contains the pins is equipped with a shunt element that can connect the pins electrically in the absence of a connection at the sleeves of the first device.

16 Claims, 7 Drawing Sheets

U.S. PATENT DOCUMENTS

| | | | | |
|---|---|---|---|---|
| 6,899,556 | B2 * | 5/2005 | Nishida et al. | 439/188 |
| 6,997,750 | B2 * | 2/2006 | Johannes et al. | 439/620.05 |
| 7,121,867 | B2 * | 10/2006 | Annecke | 439/352 |
| 7,547,232 | B2 * | 6/2009 | Johannes et al. | 439/620.07 |
| 2001/0006860 | A1 | 7/2001 | Nimura | |
| 2004/0157494 | A1 | 8/2004 | Williamson et al. | |
| 2007/0105442 | A1 | 5/2007 | Gunreben | |

FOREIGN PATENT DOCUMENTS

| | | |
|---|---|---|
| WO | 2005112201 | 11/2005 |

OTHER PUBLICATIONS

Franch Search Report and Written Opinion for priority application FA707555 (published as FR 0853211), established Jan. 7, 2009.

* cited by examiner

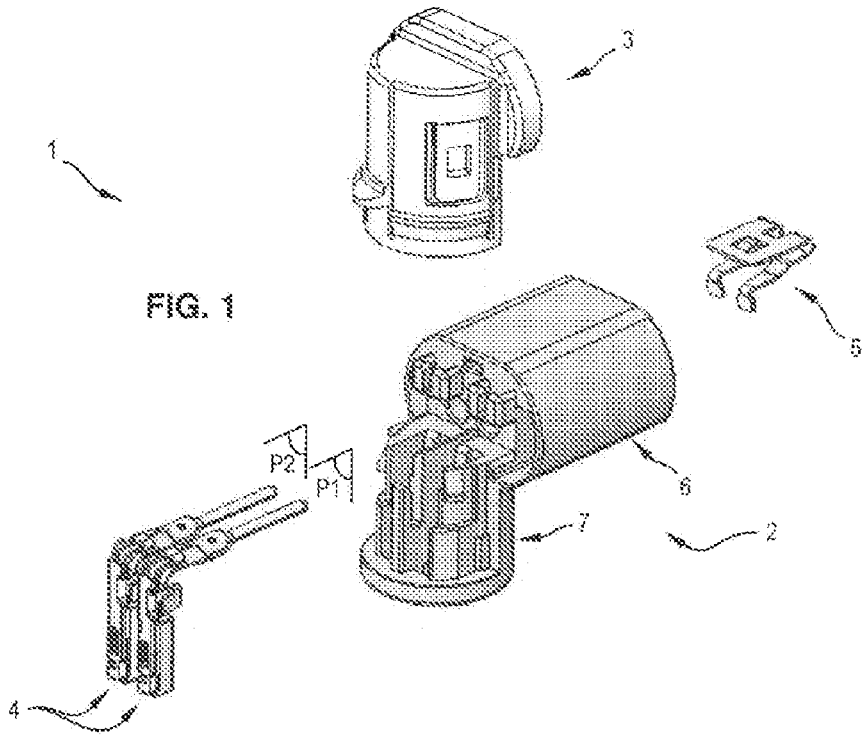
FIG. 1
FIG. 2A
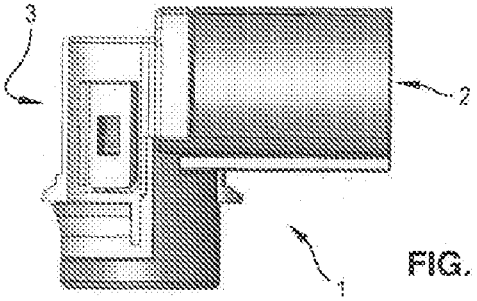
FIG. 2B
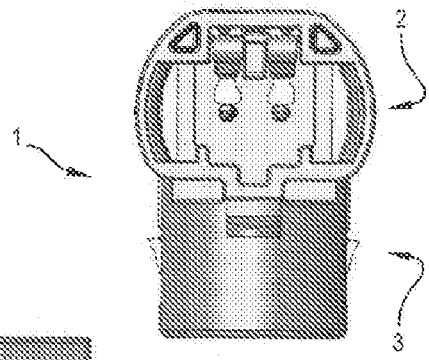
FIG. 2C
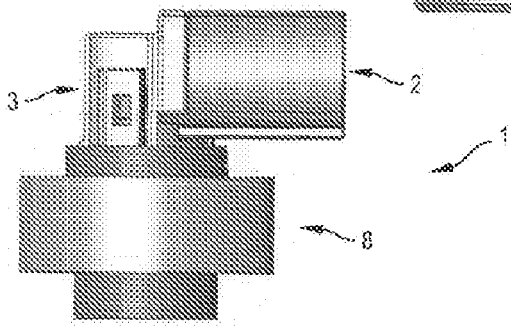

FIG. 3
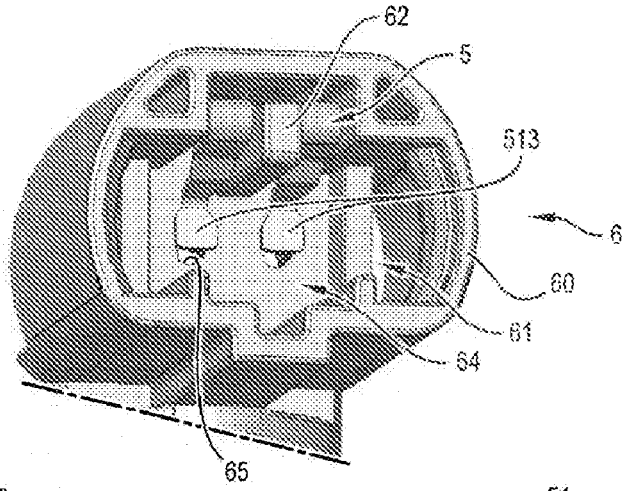
FIG. 4A
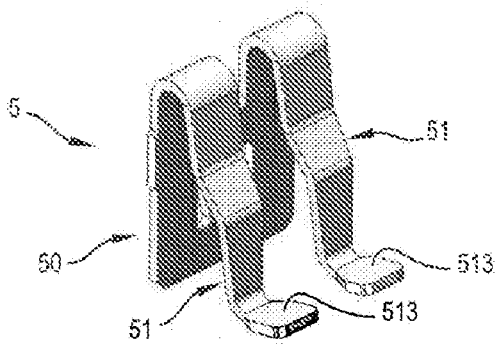
FIG. 4B
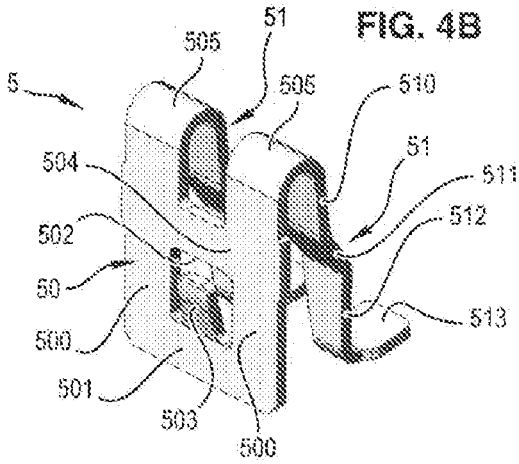
FIG. 5A
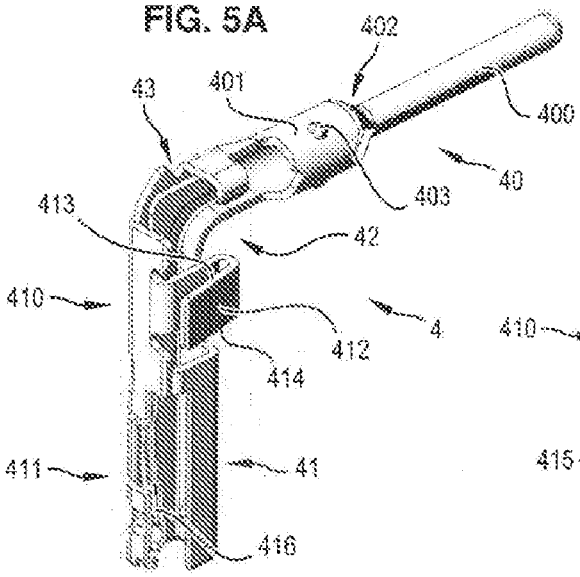
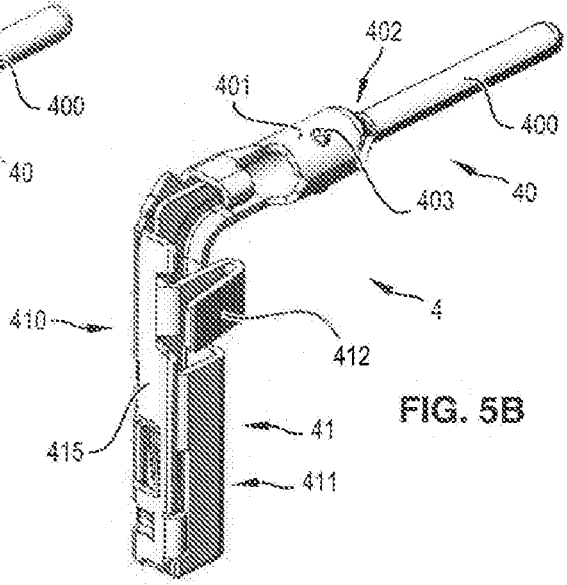
FIG. 5B

ELECTRICAL CONNECTION PART FORMED BY A CASING WITH TWO ARMS ORIENTED AT 90°

CROSS-REFERENCE TO RELATED APPLICATIONS

This application is a 371 U.S. National Stage of International Application No. PCT/EP2009/056012, filed May 18, 2009. This application claims the benefit of French Patent Application No. 08 53211, filed May 19, 2008, the disclosures of which applications are incorporated herein by reference.

The present invention relates to an electrical connection part designed to electrically connect a first and a second device, which is formed by a casing including two arms oriented at 90° with respect to each other.

A possible application of such a part is the connection of a gas microgenerator for a motor vehicle safety device to means for initiating this microgenerator.

As regards motor vehicle safety, such a gas microgenerator is currently used inside pretensioning or retracting devices for seat belts.

The problem related to the mounting of such devices essentially lies in the lack of space.

More specifically, such a pretensioner is mounted at the end of a belt loop and in the vicinity of the chassis of the vehicle. In practice, the operator has very little space for connecting the gas microgenerator to the means which, depending on a piece of information delivered by an impact detector, will cause its initiation. They are generally in the extension of each other.

Such a microgenerator generally comprises two pins or electrodes which transmit an electrical current to the load contained in the generator, thereby causing its initiation. But the connection of these pins is difficult in terms of bulkiness; so that it happens that the pins are bent.

This is not acceptable since this may compromise the triggering of the pretensioner system.

The present invention is notably directed to solving this problem by proposing an electrical connection part which allows the connection of two devices, for example the connection of a gas microgenerator to its firing device, this without being bothered by the limited space available for the assembly, without changing in any way the structure and the operation of the presently available parts, and this, in complete safety.

Another goal is to propose a connection part, the constitutive elements of which are perfectly laid out relatively to each other, without any risk of a lack of alignment or the like, which would risk being detrimental to a perfect electrical connection of the devices with each other.

Another goal of the invention is to propose a part, the different constitutive elements of which lend themselves to automated assembling.

Thus, the present invention relates to an electrical connection part designed to electrically connect a first and second device, which is formed by a casing including two arms oriented at 90° with respect to each other, wherein this casing houses a pair of electrical connectors of which a first end has the shape of a pin longitudinally housed in one of said arms, while a second end has the shape of a sleeve longitudinally housed in the other of said arms, these pins and sleeves being able to be electrically connected to matching sleeves borne by the first device, respectively to matching pins formed by the second device.

This part is essentially remarkable in that said casing consists of two independent parts, i.e. a body and a removable cover which include means for accommodating and/or means for locking said connectors, and in that the arm which houses said pins is equipped with a shunt element capable of electrically connecting said pins in the absence of a connection to the sleeves of said first device.

This structure consisting of two independent parts allows free access to the interior of the body for placing the connectors.

The presence of means for accommodating and/or means for immobilizing the connectors guarantees their proper positioning, which is required for any proper electrical connection.

Moreover, the presence of a shunt element inside the part allows any undesirable electrical current to be discharged without any risk.

In a particular embodiment, said body includes arrangements capable of allowing the connectors to be placed in a direction generally parallel to the arm receiving said pins on the one hand, and allowing said cover to be placed in a direction generally parallel to the arm receiving said sleeves on the other hand.

Both of these placements are therefore performed along perpendicular directions.

Moreover, according to other advantageous and non-limiting features of the invention:

- said shunt element includes a body and two brackets bent to 180° in order to form ends in contact with said pins;
- said associated arm includes a wall for accommodating said shunt element;
- said shunt element includes a rod for holding and locking onto said arm;
- said connectors are provided with mechanical or elastic means for locking onto said body, these means being provided so that they may not be unlocked;
- said locking means consist in a spring blade bent to 180°;
- said spring blade is in contact with and is held against a partition element firmly attached to the body;
- said pins have duct bosses inside openings provided in the body;
- said openings have peripheral bosses for lateral immobilization of said pins;
- at least one of said connectors has in the pins/sleeves connection an opening positioned in the axis of said sleeves;
- said cover includes rods capable of at least partly engaging into said opening;
- said cover includes integrated surfaces, fitted so as to slide along the sleeves;
- said connectors extend in two planes parallel to each other;
- the sleeves of said connectors extend in two parallel planes, while the pins extend in a same plane, itself parallel to the plane of the sleeves;
- the plane in which said pins extend occupies a middle position facing the planes of the sleeves.

Other features and advantages of the present invention will become apparent upon reading the detailed description which follows;

It will be made with reference to the appended drawings wherein:

FIG. 1 is a perspective view of the different members which form a first embodiment of the connection part according to the invention;

FIGS. 2A and 2B are respectively side and front views of said part;

FIG. 2C is a side view of the part of FIG. 2A, connected to a gas microgenerator through its "vertical" arm;

FIG. 3 is a perspective view of the "horizontal" arm, intended to show its internal layout and more particularly a shunt element with which it is fitted;

FIGS. 4A and 4B are perspective views, in two opposite directions of this shunt element;

FIGS. 5A and 5B are perspective views of one of the connectors of the part, FIG. 5A showing the connector with partial cutaway;

Figure 6:
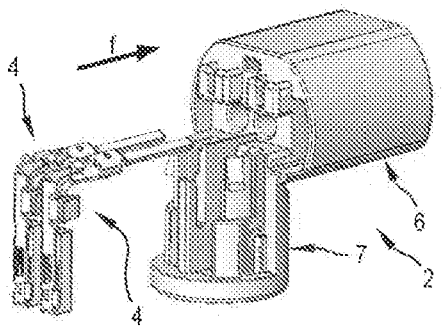
FIG. 6 is a perspective view of the body of the part and of the connectors, with the aim of showing more particularly the direction of engagement of the connectors with regard to the body.

The casing 1 illustrated in FIGS. 1-13 consists of a body 2 made up with two "arms" oriented at 90° with respect to each other.

These two arms are referenced as 6 and 7.

By convention and in order to facilitate the reading of the present description, arm 6 is described as a "horizontal arm", while arm 7 is described as a "vertical arm".

The casing 1 also comprises a cover 3 intended to cover the rear of the arm 6 as well as a large portion of the arm 7.

The arm 6 has the general shape of a sleeve open at its free end. It is delimited longitudinally by an external wall 60 and transversely by a bottom wall 64. These walls 60 and 64 delimit a cavity 61.

This cavity is adapted in order to accommodate an end with a matching shape of a device (not shown) to be electrically connected to another device. Of course, the shape of the wall 60 and therefore that of the cavity may be adapted depending on the device to be connected.

Figure 7:
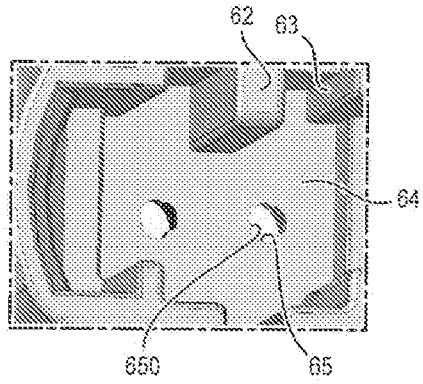
FIG. 7 is a partial view of the bottom of the "horizontal" arm, which shows the presence of orifices opening out for letting through the pins of the connectors.
Figure 8:
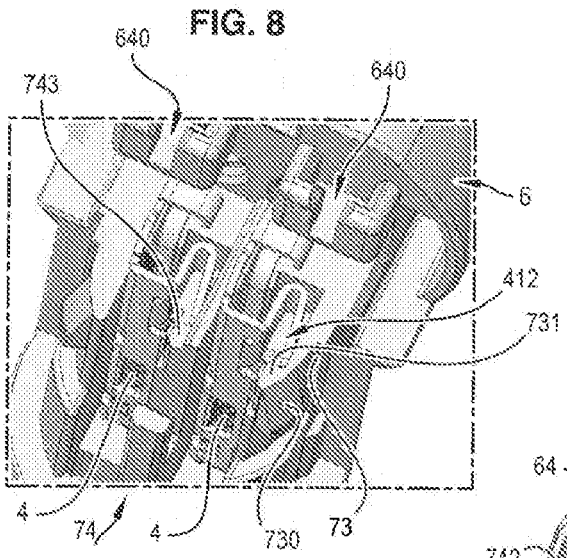
FIGS. 8 and 9 are perspective views (a partial view, for one of them) of the body on which the connectors have been mounted beforehand, which most particularly illustrate how these connectors are immobilized.

As this is notably visible in FIGS. 3 and 7, the bottom wall 64 has two opening apertures 65 with a generally circular contour. It is noted in FIG. 7 that the perimeter of these openings includes bumps or bosses 650 which are angularly distributed in a regular way. Their function will be explained later on.

Parallel to the external wall 60, in the upper portion of the arm 6, extends a longitudinally oriented wall 63. It is associated with a pad 62 positioned at half-length of the wall 63 and on the internal side thereof, i.e. towards the interior of the cavity 61.

The walls 63 and pads 62 receive a shunt element which is notably visible in FIGS. 1, 3, 4A and 4B.

This shunt element 5 is in metal and essentially includes a body 50 as well as two brackets 51.

The body 50 consists in a generally planar plate, comprising a base 501 connected to two parallel arms 500, which gives the assembly the general shape of a "U". Both arms 500 are connected at half-height through a wall element 504 forming a crossbar, which delimits a window 502 through which extends a locking rod 503, oriented at an angle and as a single part with the base 501.

Both arms 500 are folded back by 180° in order to form via curve transition areas 505, the two brackets 51 mentioned above.

These brackets from curve transition areas 505 comprise a first portion 510 parallel to the plate 50, a second portion 511 positioned at an angle and away from the plate 50, a third portion 512 parallel to the first portion 510 as well as a fourth portion 513 perpendicular to the portion 512 and away from the body 50.

This body 50 is mounted between the external wall 60 and the aforementioned wall 63 of the arm 6.

The locking rod 503 cooperates with the wall 60 and the transition areas 505 overlap the wall 63 while the pad 62 acts as a separator or spacer for both brackets 51.

As notably shown in FIG. 2B, the brackets 51 are dimensioned so that the ends 513 partly overlap the openings 65 as mentioned earlier.

As this will be seen later on, these openings 65 receive pins 40 of connectors 4. During their placement, the connectors are in direct contact with the aforementioned ends 513, so that the shunt element 5 is capable of fully fulfilling its function.

During the connection of an electrical device to the arm 6, the brackets 51 of the element 5 are pushed back towards the body 50 by said device, so that the ends 513 are then no longer in contact with the connectors.

Figure 9:
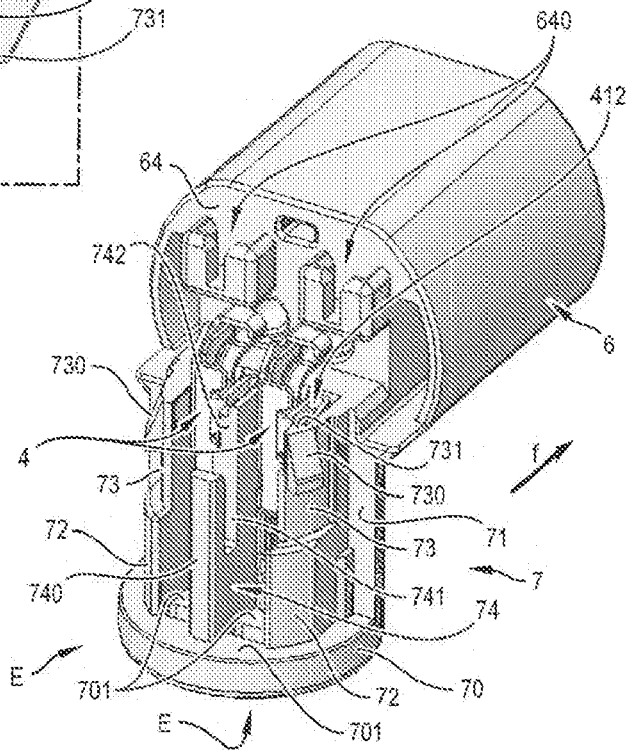
Figure 10A:
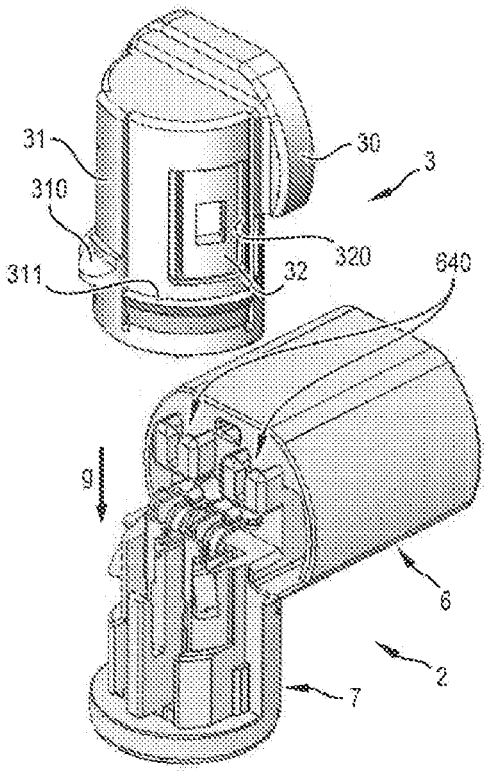
FIGS. 10A and 10B are perspective views, in two opposite directions, of the body as illustrated in FIGS. 8 and 9, and of the cover, the latter not being mounted on the body.
Figure 10B:
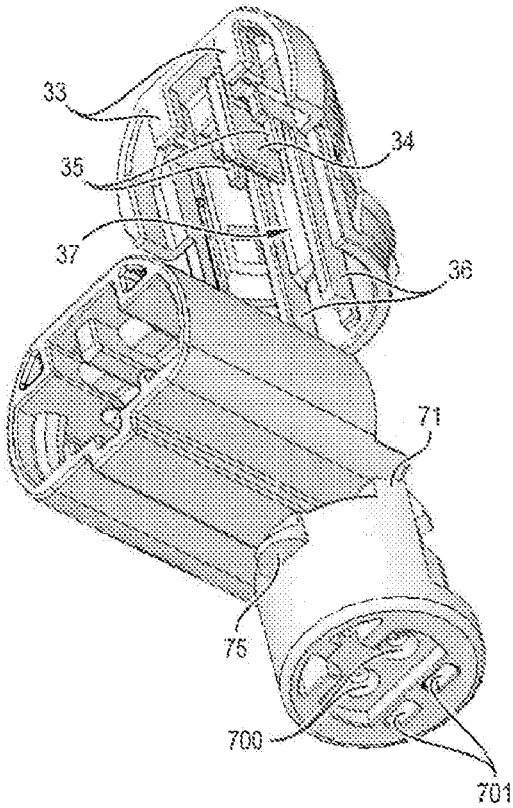
Figure 11:
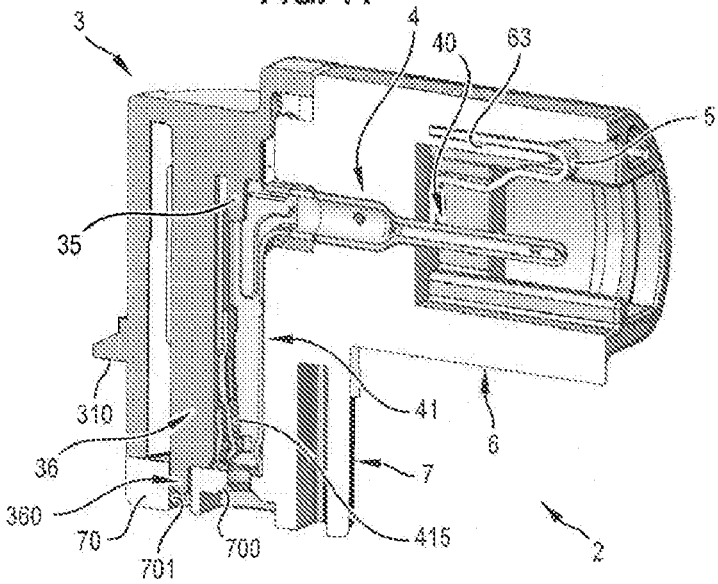
FIG. 11 is a perspective view, along a longitudinal and median sectional plane, of the connection part as illustrated in FIG. 2A.

The vertical arm 7 of the body 2, notably visible in FIG. 9, is delimited towards the bottom by a base 70 with a circular contour, which has a pair of opening apertures also with a circular contour, referenced as 700 and in particular visible in FIGS. 10B and 11.

The base 70 is also provided with an additional pair of opening apertures 701, positioned facing the apertures 700 and offset to the periphery.

From this base rises a front portion 71 turned towards the branch 6 and with a convex external surface. It bears a rod 75 positioned not very far from the arm 6 and oriented parallel to the latter.

The remainder of the vertical arm consists of a set of elements as described hereafter.

In particular, the rear face of the bottom wall 64 of the arm 6, i.e. the one turned towards the arm 7, bears, above the aperture 65, members 640 for locking the cover referenced as 3. These members are open in the vertical direction and upwards, i.e. perpendicularly to the arm 6.

The presence of two walls 72 which extend vertically from the base 70 is also noted. They have the shape of a circular arc and join the portion 71. These walls 72 extend upwards through a wall of smaller thickness and are set back, referenced as 73. The upper end of these walls 73 is provided with a snap-on rod with a tilted face 730, positioned vertically.

From the base 70 also extends another wall 74 which has a median position relatively to the walls 72 and which is positioned in a generally vertical plane. Thus, it delimits between both walls 72 two spaces E, access to these spaces being possible in a direction generally parallel to the arm 6, towards the orifices 65.

The height of the wall 74 is irregular. From the outside to the inside, it consists of a rod 740, a slot 741, as well as a high partition 742.

One of the walls 72 as well as the high partition 742 have a portion with a larger thickness referenced as 731, respectively 743, which ensures blocking of the connectors 4, as this will be seen later on.

The body 2 of the casing receives two identical electrical connectors 4 which are notably visible in FIG. 1. These connectors extend in two parallel planes P1 and P2.

Reference will now be made to FIGS. 5A and 5B which illustrate in detail one of these connectors.

This connector 4 consists of an electrically conducting metal part.

It comprises a pin 40 connected at 90° to a sleeve 41.

The pin 40 consists of a cylindrical tube 400 with a closed free end, the diameter of which corresponds to the dimensions of a sleeve of a first device to be connected.

The tube is connected to a base with larger diameter 401, the periphery of which includes a series of lugs 403, the function of which will be described later on.

The pin 40 is connected to the sleeve 41 through a curved area 42 which has an aperture 43, which gives access to the interior of the sleeve 41 in its longitudinal direction.

The sleeve 41 consists of a tube 410 with a square section, which is open at its free end 411.

Its wall 415 which is oriented opposite to the pin 40, includes an internal rod 416 positioned longitudinally and which is conformed as a spring blade.

This rod is intended to come directly in contact with a pin of a second device to be electrically connected.

In the upper portion of the wall 415, extends a means for locking the connector on the body 2 of the casing.

In this case, this is a spring blade 412 which extends from the wall 415 towards the pin 40. It includes a first arm 413, as well as a second end arm 414 oriented at 180°.

As this is shown more particularly by FIGS. 6 and 9, placement of the connectors is accomplished in the direction of the arrow f, generally parallel to the arm 6.

During this placement, the sleeves 41 are brought closer to the spaces E of the arm 7, delimited by the walls 72 and 74.

The tubes 400 of the pins 40 are inserted into the openings 65. During this movement, the spring blades 412 of the connectors are compressed and will snap on, and then be blocked against the overthicknesses 731 and 743 of the arm 7.

The bosses 650 which equip the openings 65 contribute to lateral immobilization of the pins 40, while the lugs 403 contribute to compensation of the possible plays which would exist between the base 401 and the passage which receives them.

Thus, the connectors 4 are perfectly placed in the casing.

Further, any removal of these connectors is impossible in a direction parallel to the arm 7. On the other hand, removal is possible along a direction parallel to the arm 6, if one voluntarily acts on the spring blades 412.

The cover 3 includes an upper flange with a curved contour similar to that of the arm 6, this flange being open in its lower portion. It is connected to a body 31 with a curved wall, with the same curvature as the exposed portion of the base of the arm 7.

On the external surface of the body 31, it is noted that a rod 310 adapted for limiting the relative engagement of the casing 2 relatively to a device to be electrically connected, is present in a median position close to its free end.

On either side of this finger, the presence of a tab 311, positioned outwards (at an angle), opposite the free end of the body 31, is noted.

As this will be seen later on, this tab is intended to be engaged in matching means by snapping it on, which are provided in the device to be connected.

Above the tabs 311, two recesses 32 are provided with an opening 320, the function of which will be explained later on.

A set of rods which will be described more specifically hereafter extends on the internal side of the body 31.

Thus, from the upper portion of the flange 30, two rods 33 with a T-shaped cross-section, the transverse bar of which is intended to engage into the locking members 640 borne by the casing 2, extend towards the end of the body 31.

The presence of two rods 35 with reduced length is also noted, provided for partially engaging into the openings 43 of the connectors 4 at their curved intermediate portion 42.

A bracket 34 is moreover positioned between the rods 35, in order to engage inbetween the connectors 4.

Finally, the presence of two rods 36 of great length is also noted, positioned on either side of the rods 35, provided so as to be positioned along the connectors 4, and more particularly along their face 415. The free end of these rods is conformed in order to cooperate with the openings 701 of the base.

FIG. 11 accounts for the mutual cooperation between the cover 3 and the casing 2.

As stated earlier, the engagement of the cover 3 with respect to the casing 2, is accomplished in a direction parallel to the arm 7, in the direction of the arrow g.

By doing this, the rods 731 of the arm 7 are locked in the windows 320 of the cover. Moreover, the rods 35 of the cover partially fit into the openings 43 of the connectors, while the rods 36 will be positioned against the face 415 of these connectors.

By means of this layout, if the connectors are not properly positioned, the cover cannot properly engage on the casing 2.

On the contrary, if it locks, this means that the rods 35 and 36 are properly positioned relatively to the connectors 4, so that perfect placement of all the elements of the part is guaranteed.

Figure 12:
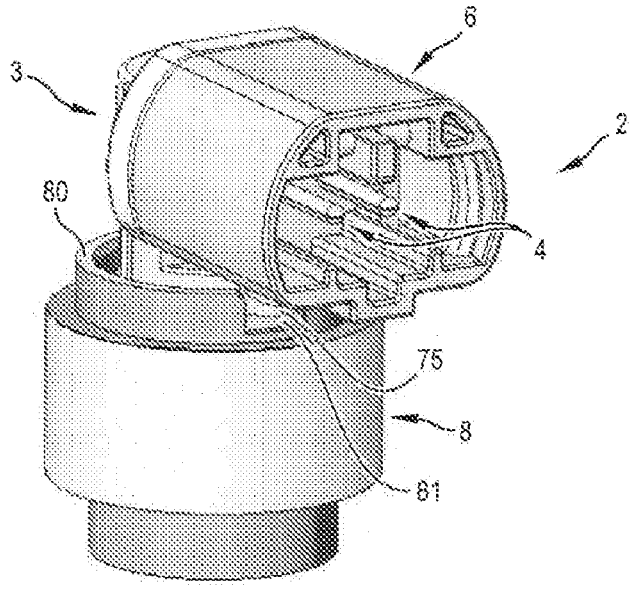
FIG. 12 is a perspective view of the assembly of FIG. 2C.
Figure 13:
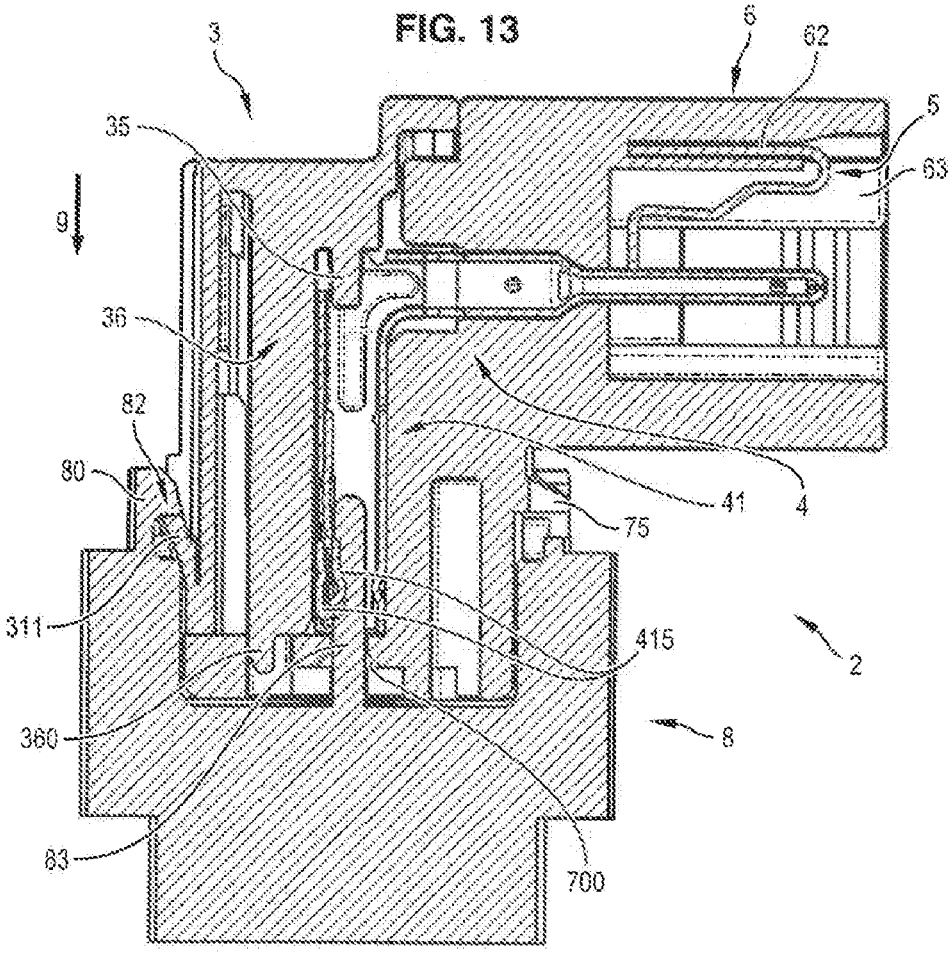
FIG. 13 is a side view, along a longitudinal and median sectional plane of the assembly of FIGS. 2C and 13.

With FIGS. 12 and 13, it is possible to fully understand how the part according to the invention cooperates with a device to be electrically connected, the latter including a pair of pins.

The relevant device bears reference 8 and has a cylindrical shape with an upper peripheral flange 80.

The latter has a cut-out 81 for receiving the blocking rod 75 borne by the front face of the arm 7 of the body 2.

As this is visible in FIG. 13, the internal side of the flange 80 is conformed as a snap-on tooth 82 for accommodating and blocking the tab 311 which equips the cover 3.

The device includes pins 83 of the same type as the pins 40. These pins 83 are perfectly engaged in the sleeves 41 of the connectors 4, the spring blade 415 providing perfect contact between the pins 83 and the matching sleeves 41.

An alternative of the device according to the invention is illustrated in FIGS. 14-20.

It shows a structure analogous to the one which has just been described. Accordingly, the elements, which bear references identical with those of the device of the first alternative, should be considered as identical or similar.

The main difference, which this embodiment has, consists in the particular orientation of the pins of both electric connectors with which it is equipped. These connectors are referenced as 4' and 4" in the figures.

Figure 16A:
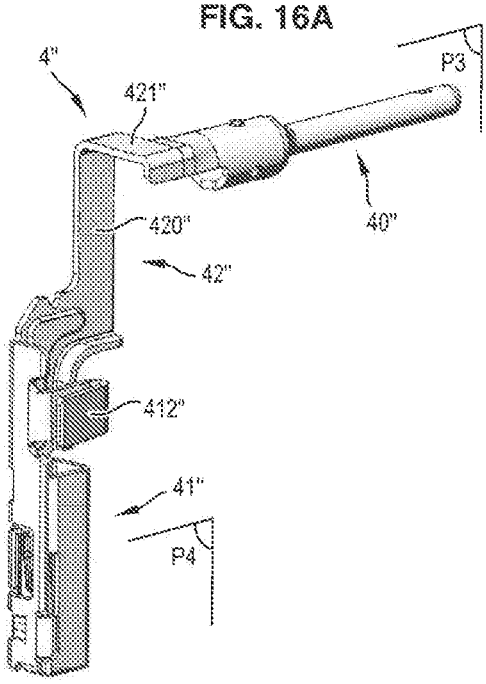
FIGS. 16A and 16B are perspective views of the connectors which equip this alternative embodiment.
Figure 16B:
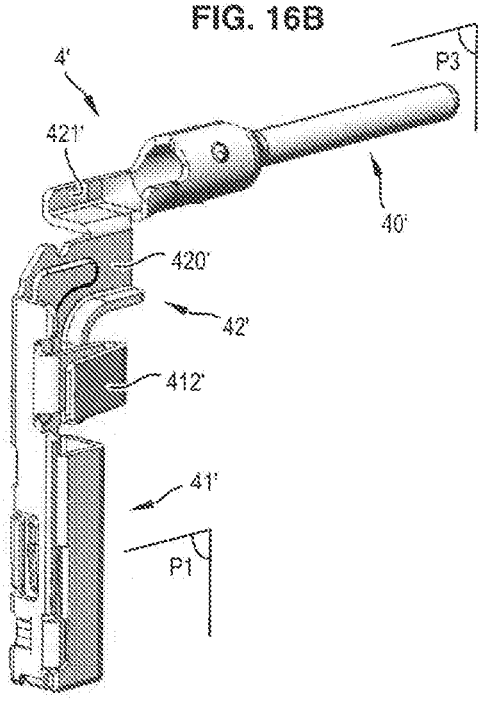
Figure 17:
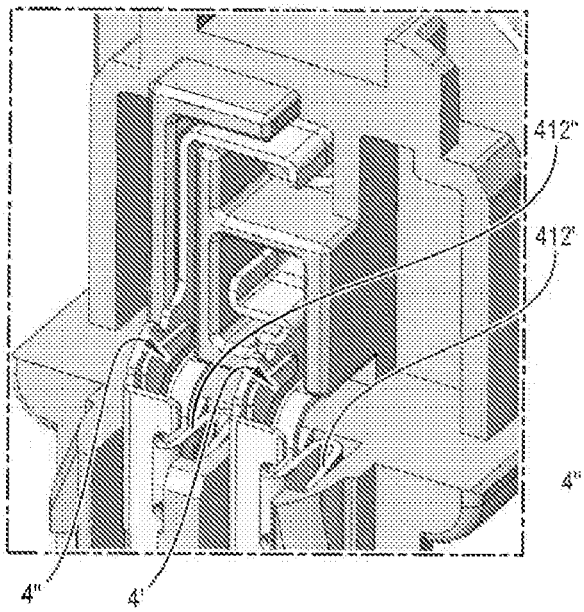
FIGS. 17, 18, 19 and 20 are views analogous to FIGS. 8, 9, 10A and 10B of this embodiment.
Figure 18:
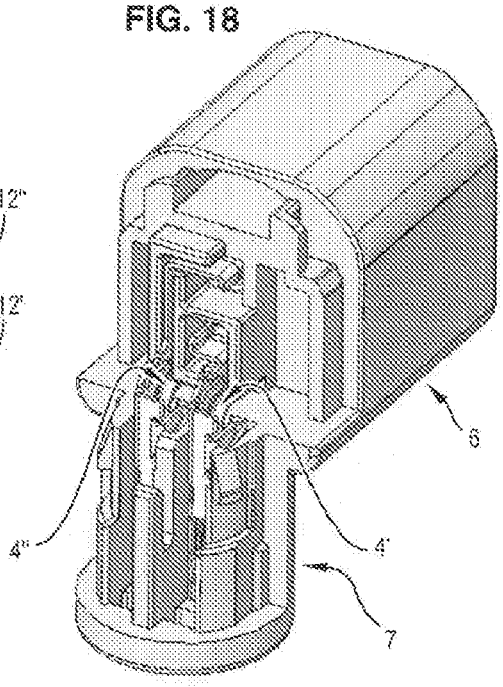
Figure 19:
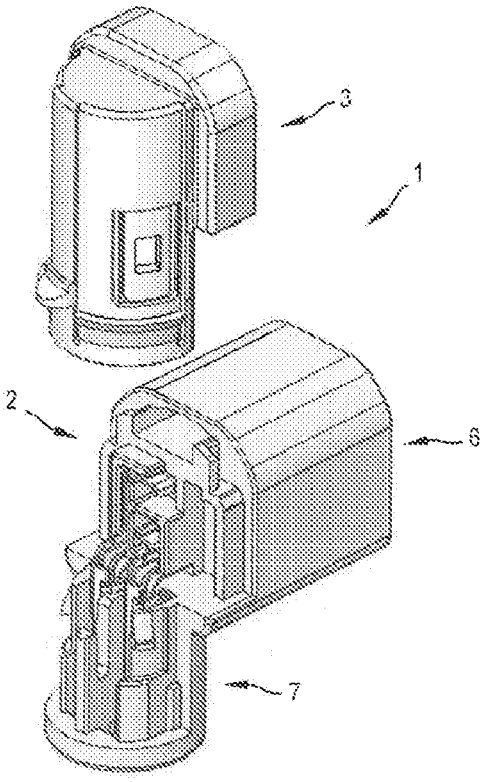
Figure 20:
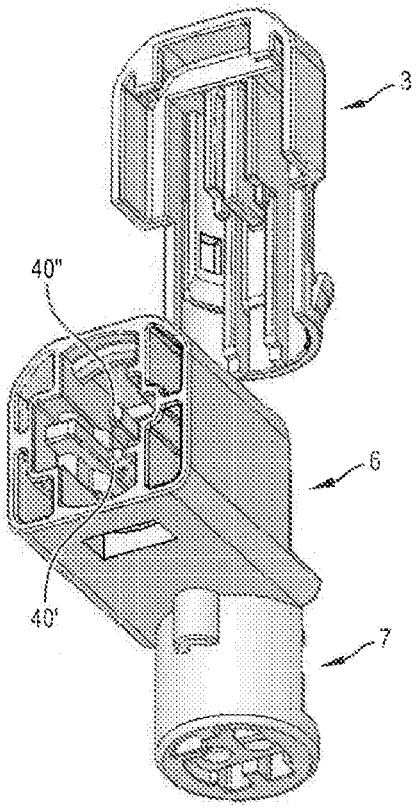

The connector 4' illustrated in FIG. 16B has a structure relatively similar to that of the connector 4 of FIGS. 5A and 5B. The elements common to both of these embodiments bear the same reference accompanied with the prime index.

The only notable difference lies in the fact that pin 40 extends in a plane $P_3$ parallel, i.e. shifted, relatively to the plane of the sleeve 41'.

The same applies for the connector 4" of FIG. 16A, it being specified that the pin 40" is shifted in the opposite direction, and is located in a plane $P_3$ parallel to the plane $P_4$ of the sleeve 41".

Figure 14:
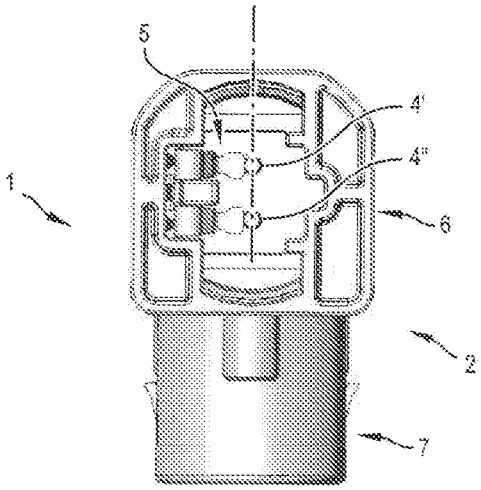
FIGS. 14 and 15 are views analogous to FIGS. 2B and 2C of a second embodiment of the connection part.
Figure 15:
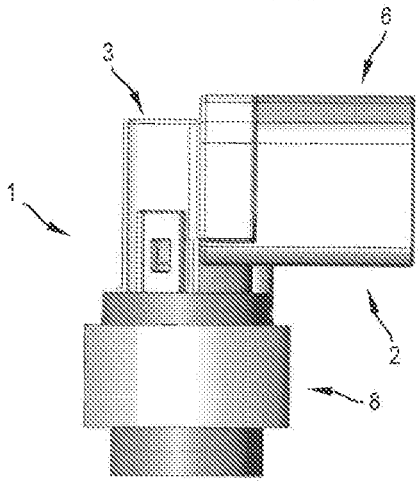

By this particular layout, and as this is most particularly shown in FIG. 14, a positioning of the pins 40' and 40" is obtained so that they are aligned in a same vertical plane $P_3$.

The invention claimed is:

1. An electrical connection part for electrically connecting a first device including a pair of first device sleeves and a second device including a pair of second device pins, the electrical connection part comprising:

a casing having first and second arms oriented at 90° with respect to one another; and a pair of electrical connectors housed by the casing, each electrical connector having a first end in the shape of a pin, each pin housed longitudinally in one of the arms, a second end of each electrical connector in the shape of a sleeve housed longitudinally in the other of the arms, the pins and sleeves operable to be electrically connected to matching first device sleeves of the first device, respectively to matching the second device pins of the second device;

wherein the casing is formed by a body and a removable cover, the removable cover including means of accommodating and/or means of locking the connectors, and the arm which contains the pins has a shunt element that can connect the pins electrically in the absence of a connection at the sleeves of the first device.

2. The part of claim 1, wherein the body has recesses capable of permitting the connectors to be fitted in a first direction generally parallel to the arm housing the pins and, the cover to be fitted in a second direction generally parallel to the arm housing the sleeves.

3. The part of claim 1, wherein the connectors extend in two planes that are parallel to one another.

4. The part of claim 1, wherein at least one of the connectors has, in the pins/sleeves connection zone, an opening positioned in the axis of the sleeves.

5. The part of claim 4, wherein the cover includes at least one rod that can be engaged at least partially into each of the openings.

6. The part of claim 1, wherein the sleeves of the connectors extend in first and second parallel planes, while the pins extend in a third plane, parallel to the first and second planes.

7. The part of claim 6, wherein the third plane is positioned substantially halfway between first and second planes.

8. The part of claim 1, wherein the connectors have mechanical or elastic means for locking onto the body, wherein these means are provided so that they may not be unlocked.

9. The part of claim 8, wherein the locking means include a spring blade bent to 180° .

10. The part of claim 9, wherein the spring blade is in contact with and is held against a partition element that is attached to the body.

11. The part of claim 1, wherein the shunt element has a shunt body and two brackets bent to 180° to form the contact ends with the pins.

12. The part of claim 11, wherein the associated arm features a wall to house the shunt element.

13. The part of claim 11, wherein the shunt element includes a rod for holding and locking onto the arm.

14. The part of claim 1, wherein the pins have duct bosses inside openings made inside the body.

15. The part of claim 14, wherein the openings have peripheral bosses for the lateral immobilization of the pins.

16. The part of claim 14, wherein the cover includes integrated surfaces, fitted so as to slide along the sleeves.

* * * * *